US008588431B2

(12) United States Patent
Aggarwal et al.

(10) Patent No.: US 8,588,431 B2
(45) Date of Patent: Nov. 19, 2013

(54) ELECTRICAL SYSTEM FOR A SPEAKER AND ITS CONTROL

(75) Inventors: Ashish Dharmpal Aggarwal, Santa Clarita, CA (US); Subramanyam Kasibhat, Bangalore (IN)

(73) Assignee: Snap Networks, Inc., Bangalore (IN)

( * ) Notice: Subject to any disclaimer, the term of this patent is extended or adjusted under 35 U.S.C. 154(b) by 237 days.

(21) Appl. No.: 12/988,486

(22) PCT Filed: Apr. 20, 2009

(86) PCT No.: PCT/US2009/002458

§ 371 (c)(1),
(2), (4) Date: Nov. 30, 2010

(87) PCT Pub. No.: WO2009/131658

PCT Pub. Date: Oct. 29, 2009

(65) Prior Publication Data

US 2011/0064258 A1 Mar. 17, 2011

Related U.S. Application Data

(60) Provisional application No. 61/046,740, filed on Apr. 21, 2008.

(51) Int. Cl.
*H04R 29/00* (2006.01)
*H04R 3/00* (2006.01)

(52) U.S. Cl.
USPC ..... 381/58; 381/59; 381/95; 381/96; 381/122

(58) Field of Classification Search
USPC ..... 381/58, 59, 95, 96, 309, 310, 91, 92, 381/122, 61
See application file for complete search history.

(56) References Cited

U.S. PATENT DOCUMENTS

| | | | | |
|---|---|---|---|---|
| 5,289,355 | A | 2/1994 | Cimock | |
| 5,410,735 | A | 4/1995 | Borchardt et al. | |
| 5,980,057 | A | 11/1999 | Christie | |
| 7,158,643 | B2 * | 1/2007 | Lavoie et al. | 381/58 |
| 7,680,286 | B2 * | 3/2010 | Hashimoto et al. | 381/86 |
| 7,860,260 | B2 * | 12/2010 | Kim et al. | 381/310 |
| 7,869,611 | B2 * | 1/2011 | Asada | 381/303 |
| 7,889,878 | B2 * | 2/2011 | Takumai | 381/303 |
| 8,023,662 | B2 * | 9/2011 | Mitsuhashi et al. | 381/66 |
| 8,290,167 | B2 * | 10/2012 | Pulkki et al. | 381/23 |
| 2005/0066626 | A1 | 3/2005 | Hutcheon | |
| 2006/0201740 | A1 | 9/2006 | Hsueh | |
| 2011/0013778 | A1 * | 1/2011 | Takumai | 381/17 |

* cited by examiner

*Primary Examiner* — Xu Mei
(74) *Attorney, Agent, or Firm* — Rahman LLC

(57) ABSTRACT

An electrical apparatus includes a frame, a speaker connected to the frame, a digital signal processor in communication with the speaker to receive audio data and control data to control the speaker, the digital signal processor connected to the frame, and a lamp base coupler electrically connected to the speaker and receiver, the lamp base coupler detachably connectable to a power source, when the power source is present. A method of steering the diffused sound field includes, broadcasting at least one calibration audio signal through a plurality of speakers (M) in an audio system, receiving the calibration audio signal in a plurality of microphones spaced apart and positioned about at a listening position, and calculating respective relative speaker placement angles relative to the listening position between each of the plurality of speakers in response to receipt of the calibration audio signal in the plurality of microphones.

13 Claims, 9 Drawing Sheets

ELECTRICAL SYSTEM FOR A SPEAKER AND ITS CONTROL

CROSS-REFERENCE TO RELATED APPLICATIONS

This application claims priority to PCT application number PCT/US2009/002458, filed on Apr. 20, 2009, which claims priority to U.S. provisional application No. 61/046,740, filed on Apr. 21, 2008, the contents of which, in their entireties, are herein incorporated by reference.

BACKGROUND OF THE INVENTION

1. Field of the Invention

This invention relates to speakers, and more particularly to speakers adapted for use in the hotels, restaurants, home or living areas.

2. Description of the Related Art

Music, audio and movie sound tracks recorded are rapidly becoming available to the average consumer for playback in the home and other environments. Commercial enterprises such as restaurants and hotel suits also provide music to their customers. Typically, the speakers in such systems are physically connected and receive amplified analog audio signals coming from a central amplifier source. In some applications multichannel playback is desired where the goal is to create a surround sound experience using directional sound cues. In order to achieve this effect, different speakers may receive different sound signals. Playback of such pre-recorded multichannel sound is fully realized with pre-determined placement of speakers so that a listener at a pre-determined listener position experiences the full effect of such multichannel encoding. Moreover, it is desired that the sound coming out of speakers be directed towards the predetermined listening position so that directional sound cues are clearly identifiable. A speaker is generally designed to emit sound from its front. Therefore, achieving proper directional sound cues depends on the proper orientation of the speakers such that sound is directed towards the pre-determined listening position. The entire system setup therefore necessitates running independent wires from the central amplifier to each of the speakers and careful placement of each of these speakers to create a pleasing surround sound experience.

For example, proper playback of a movie encoded in Dolby 5.1 or DTS 5.1 sound in a typical living room (See FIG. 1 (PRIOR ART)) would require placement of front, center and right speakers (102, 104, 106) in pre-determined positions relative to the listener's position 108, as well as surround left and surround right speakers (110, 112) to the left and right of the listener's position, respectively (each referred to herein as "channels" or "ideal channels").

For channels driven by a central sound source, such as a receiver amplifier 1 14, professional and aesthetic placement of speakers may require entry into the interior of wall spaces or ceilings to run speaker cable from the central amplifier source to each respective speaker. The speakers need to be carefully positioned keeping into account two critical aspects—the angle at which the speaker is placed relative to the listening position and the direction in which the speaker is oriented. Placement of a subwoofer for such encoding, although not as critical, would still require running speaker cable and/or power cabling. In some consumer premises that do not offer access to an adjacent attic or basement or that do not have hollow—walled construction, such wire runs may difficult and expensive. For some consumers, such installation may be impossible to accomplish aesthetically. For speakers which may receive the pre-amplified audio signal wirelessly, most speakers still require suitable access to power, typically using between 120V and 230V AC, again resulting in similar challenges.

In a different the scenario such as restaurant where only a single track of sound is played through all the speakers, running wires is cumbersome. Moreover, since each speaker receives the same amplified analog audio signal, the volume of each speaker cannot be controlled independently thereby giving the same loudness level to all the customers.

A need still exists, therefore, for an audio system that provides for easy installation of suitable signaling and power to allow proper audio broadcast of popular encoding formats without the necessity of inconvenient or expensive demolition and repair of a consumer's premises and allows for independent control of each speaker.

SUMMARY OF THE INVENTION

An electrical apparatus is disclosed that has a frame, a speaker connected to the frame, and a digital signal processor connected to the frame and in communication with the speaker to receive audio data and control data to control the speaker. The lamp base coupler is electrically connected to the speaker and receiver and is detachably connectable to a power source, such as, for example, through a screw-thread base, bayonet mount and multi-pronged pin base. With the above embodiment, the speaker and digital signal processor on the frame may be detachably connected to the power source through the lamp base coupler such that the sound signal may be individually controlled.

In one embodiment, the digital signal processor may receive audio data and control data using either wireless radio frequency (RF) or power line communication techniques.

In one embodiment, a method is presented for creating a diffused sound field through a specially designed sound diffuser.

In another embodiment, the electrical apparatus may also consist of light which is electrically connected to the lamp base such that the color of light may be individually controlled.

In another embodiment of the invention, a method of steering a sound field includes broadcasting at least one calibration audio signal through each of a plurality of speakers (M) in an audio system, receiving the at least one calibration audio signal in a plurality of microphones spaced apart and positioned at a listening position, and calculating respective relative speaker placement angles relative to the listening position between each of the plurality of speakers in response to receipt of the at least one calibration audio signal in the plurality microphones so that the angular location of each of the plurality of speakers is determined in relation to the listening position to facilitate positioning of the virtual channel.

In an implementation of the invention, the method also includes receiving a digital audio signal comprising a plurality of input digital audio signal channels (N) to generate an input audio channel amplitude vector representing a sound field, determining an ideal virtual channel position relative to the listening position for each of the plurality of input digital audio signal channels (N), rotating the sound field to generate a virtual output audio channel amplitude vector to simulate the ideal virtual channel position relative to the listening position, and amplifying the virtual output audio channel amplitude vector through the plurality of speakers (M) so that the plurality of input digital audio signals (N) are rotated for amplification through the plurality of speakers (M) for broadcast in an audio system that simulates ideal channel positions relative to the listening position.

BRIEF DESCRIPTION OF THE DRAWINGS

The components in the figures are not necessarily to scale, emphasis instead being placed upon illustrating the principals of the invention Like reference numerals designate corresponding parts throughout the different views.

DETAILED DESCRIPTION

Figure 2:
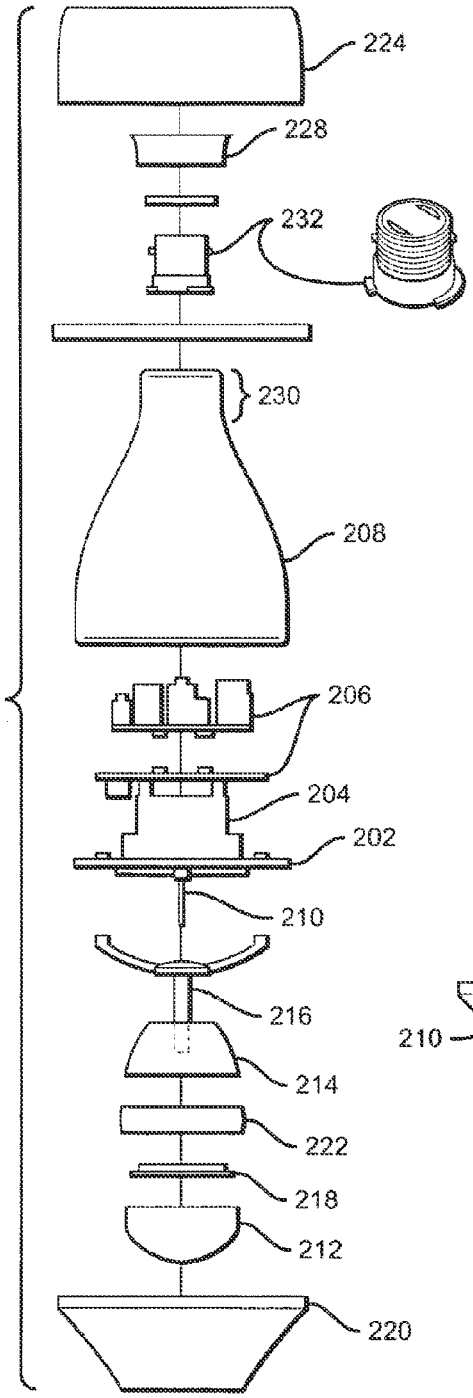
FIG. 2 is an exploded plan view of one embodiment of a speaker and light assembly driven by the transmitter illustrated in FIG. 6.

FIG. 2 illustrates one embodiment of a speaker and light assembly. A frame, preferably a speaker mounting bracket 202, receives a speaker 204 and printed circuit board (PCB) 206 for positioning in a body housing 208 that preferably provides thermal conduction of waste heat during operation. In one embodiment, a receiver 400 (see below) is seated on PCB 206, including a speaker electronics such as a digital signal processor and amplifier (not shown) for driving the speaker 204. Preferably, the body housing 208 is formed from a metal such as aluminum to facilitate thermal conduction of waste heat away from the speaker electronics. Preferably two RF antennae 210 are connected to the PCB 206 on opposing sides of speaker mounting bracket 202 to provide greater signal diversity than would otherwise be obtained with a single antenna. Upper and lower clamshells (212, 214) forming a sound diffuser 215 are coupled to the speaker bracket 202 through a mounting bracket assembly 216. The sound diffuser is shaped and spaced in complimentary opposition to the speaker 204 to create a diffused sound field during its operation. The lower clamshell 214 is preferably conical or other pre-determined shape to provide a desired sound diffusion.

In a preferred embodiment, an LED light 218 is seated inside the diffuser assembly 215 to project light through a translucent decorative filter 220. The upper and lower clamshells (212, 214) are preferably a translucent frosted polycarbonate or other thermoplastic polymer, glass or other resin that is suitably translucent and resistant to heat such as would be found adjacent to an LCD light. The diffuser assembly 215 also preferably has an aluminum coupler 222 between upper and lower clamshells (212, 214) to provide thermal conduction of waste heat generated from the LED 218. Housing outer ring 224 is preferably formed from translucent polyurethane material and is seated on speaker bracket 202 circumferentially about a proximal end 226 of the body housing 208. A top ring 228, preferably formed from a translucent polycarbonate, is circumferentially seated on a distal end 230 of the body housing 208. In one embodiment, a lamp base coupler 232 is coupled to the body housing 208 at the distal end 230 to detachably connect to standard household or commercial business power circuits. The lamp base coupler is preferably suitable for the application and national standards legislation applicable to the geographic region of use, such as an Edison screw socket ("E" base), bayonet mount or multi-pronged pin base such as used in a 2 or 3-pin socket. Examples of 2 or 3-pin sockets include, but are not limited by, Types C (CEE 7/16, CEE 7/17), D (BS 546 5A/250V), and M (BS 546 15A) used in India and other countries and Types A (NEMA 1-15 USA 2 pin), and B (NEMA 5-15 USA 3pin) used in the United States.

Figure 3:
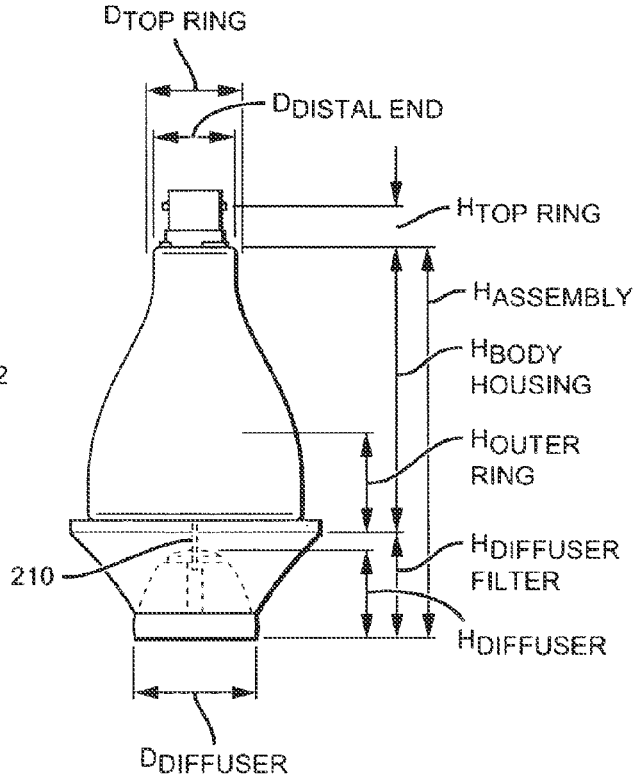
FIG. 3 is a plan view of the speaker and light assembly illustrated in FIG. 2.

In one speaker and light assembly adapted for use in a home or restaurant environment, the various elements of the assembly illustrated in FIG. 3 would have the approximate dimensions listed in Table 1.

Table 1

Figure 4:
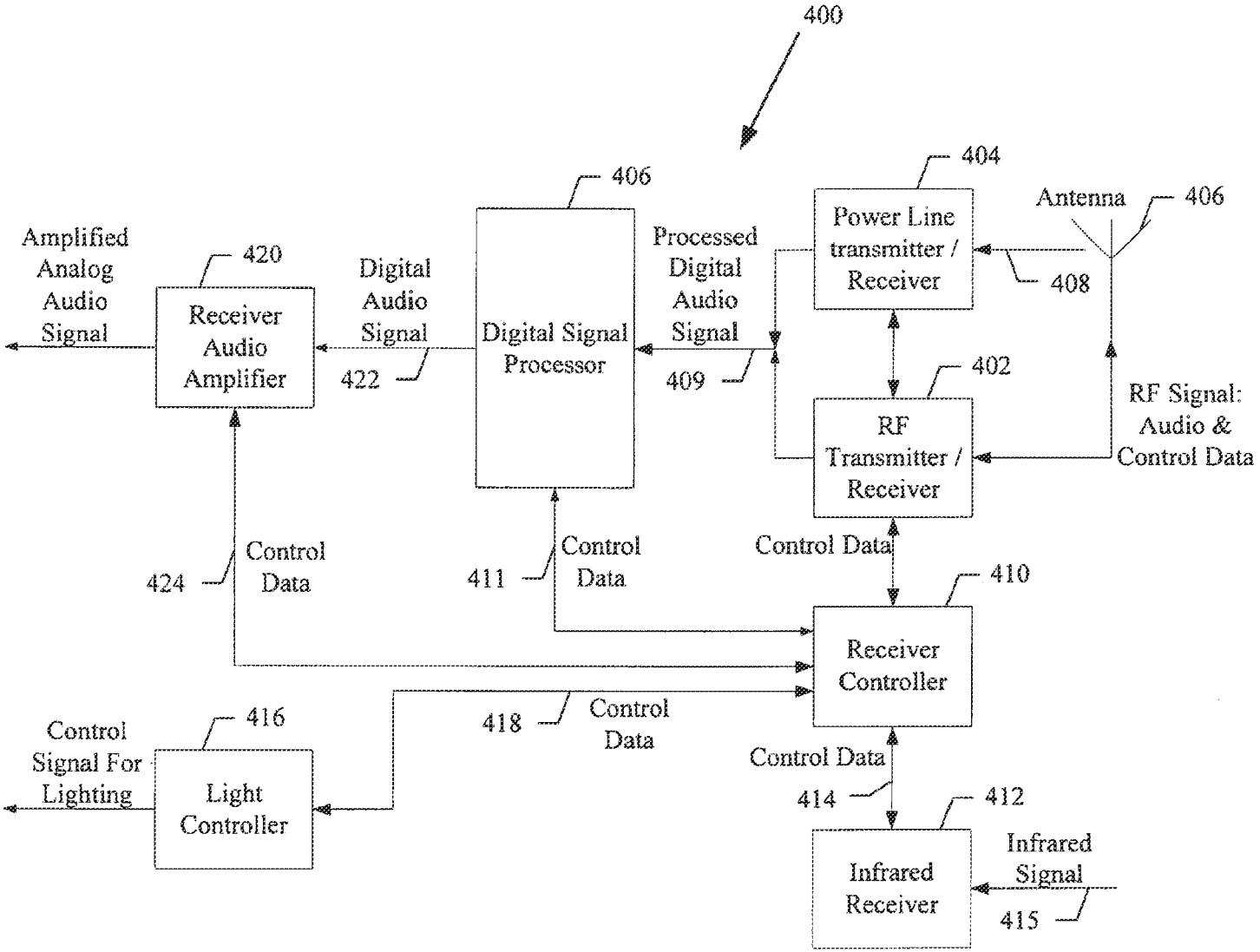
FIG. 4 is block diagram of, in one embodiment, a receiver to receive audio and control data from the transmitter illustrated in FIG. 6 to drive a speaker and control lighting.

Referring to FIG. 4, a receiver 400 is illustrated for use in the speaker and lamp assembly illustrated in FIGS. 2 and 3. An RF transmitter/receiver 402 and a power line transmitter/receiver 404 are configured to receive audio and control data from an antenna 406 and receiver power line 408, respectively. Preferably, the RF transmitter/receiver 402 passes processed digital audio signal to the digital signal processor 406 through processed digital audio signal path 409. End user control data, such as volume, light or- transmitter control data is received in the receiver controller 410 through the infrared receiver 412 by way of control data path 414. In an alternative embodiment, such end user control data may also be received by the receiver 400 through RF Transmitter/Receiver 402.

Figure 7:
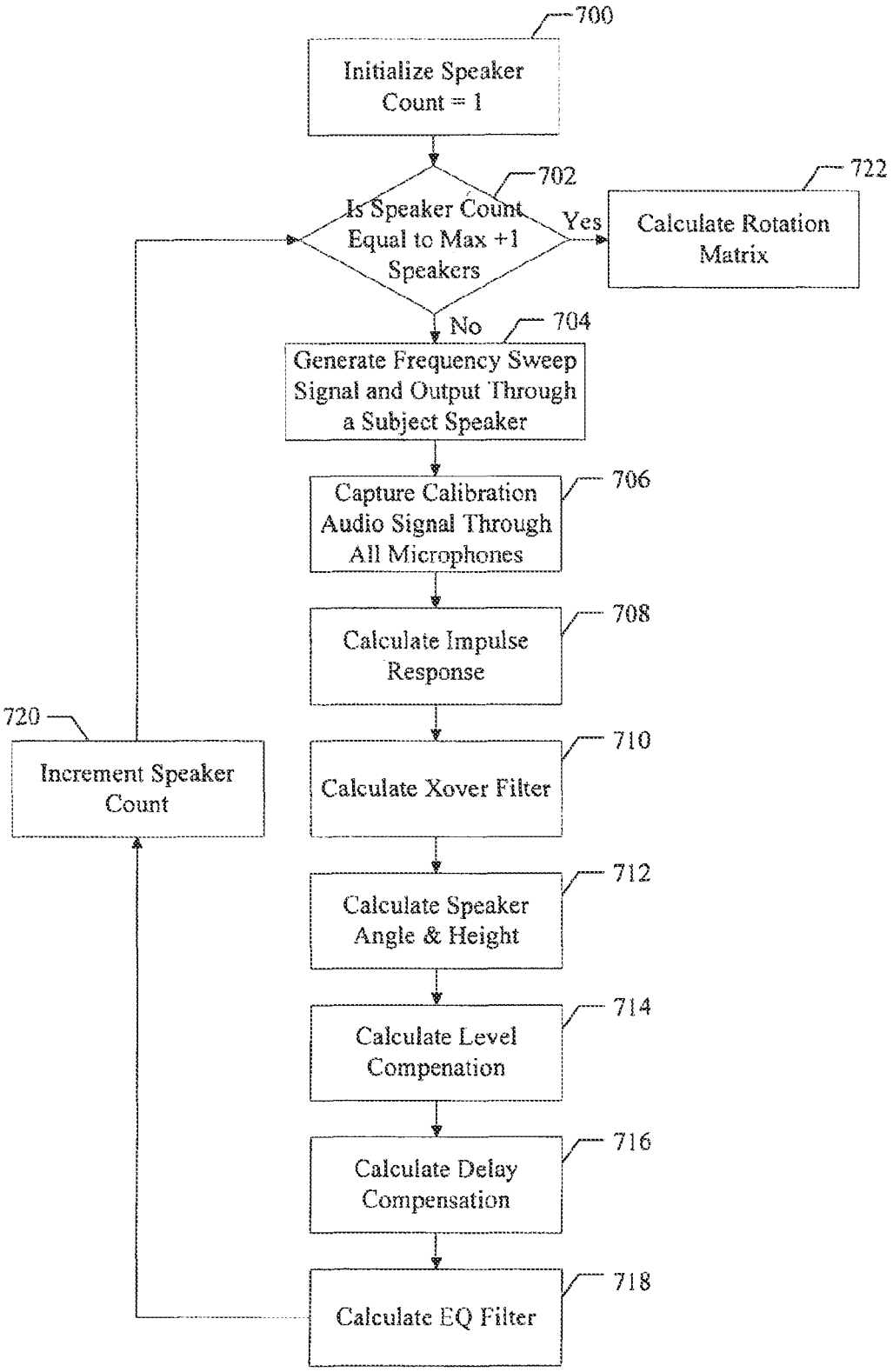
FIG. 7 is one embodiment of a flow diagram illustrating generation of audio field design parameters to enable simulation of ideal channel placement relative to a listening position.

The light controller 416 is in communication with the receiver controller 410 through light control data path 418 to control lighting in the speaker and light assembly 200, such as the LED 718 (See FIG. 7). A receiver audio amplifier 420 is coupled to the digital signal processor 1006 through digital audio signal path 422 to receive a digital audio signal for amplification to the speaker 204 (not shown). The receiver audio amplifier 420 is also in communication with the receiver controller 410 to receive control data through receiver controller data path 424, such as increase/decrease volume control data received by the receiver controller 410 from either the digital signal processor 406 through the DSP control data path 411 or from the end user through the infrared receiver 412. In one embodiment, light control data may be received through the receiver controller 410 from the digital signal processor 406 and is correlated with a volume or frequency characteristic of the digital audio signal to provide a visual association with such audio signals.

Figure 1:
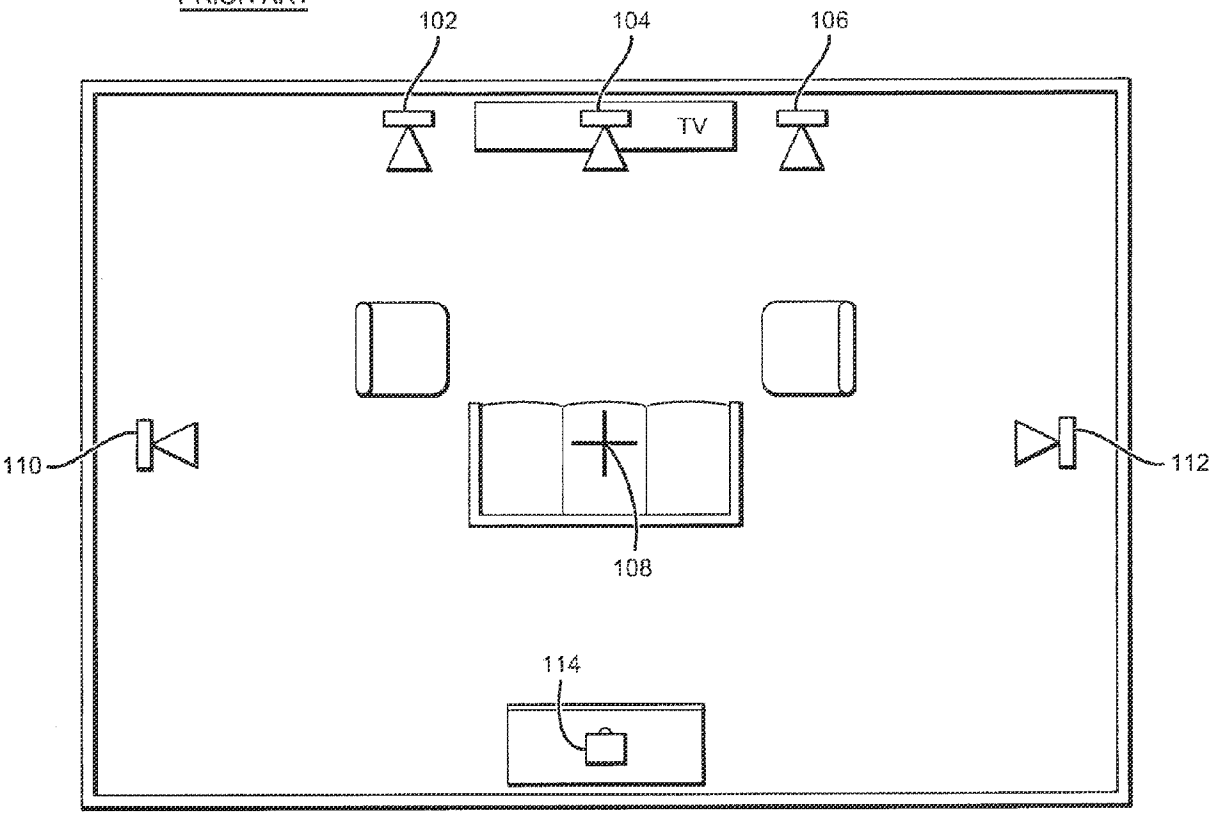
FIG. 1 PRIOR ART
FIG. 1 (PRIOR ART) is a block diagram of an audio system configured with five speakers positioned in a room in ideal channel locations for broadcast of a 5.1 encoded audio signal to a listening position.
Figure 5:
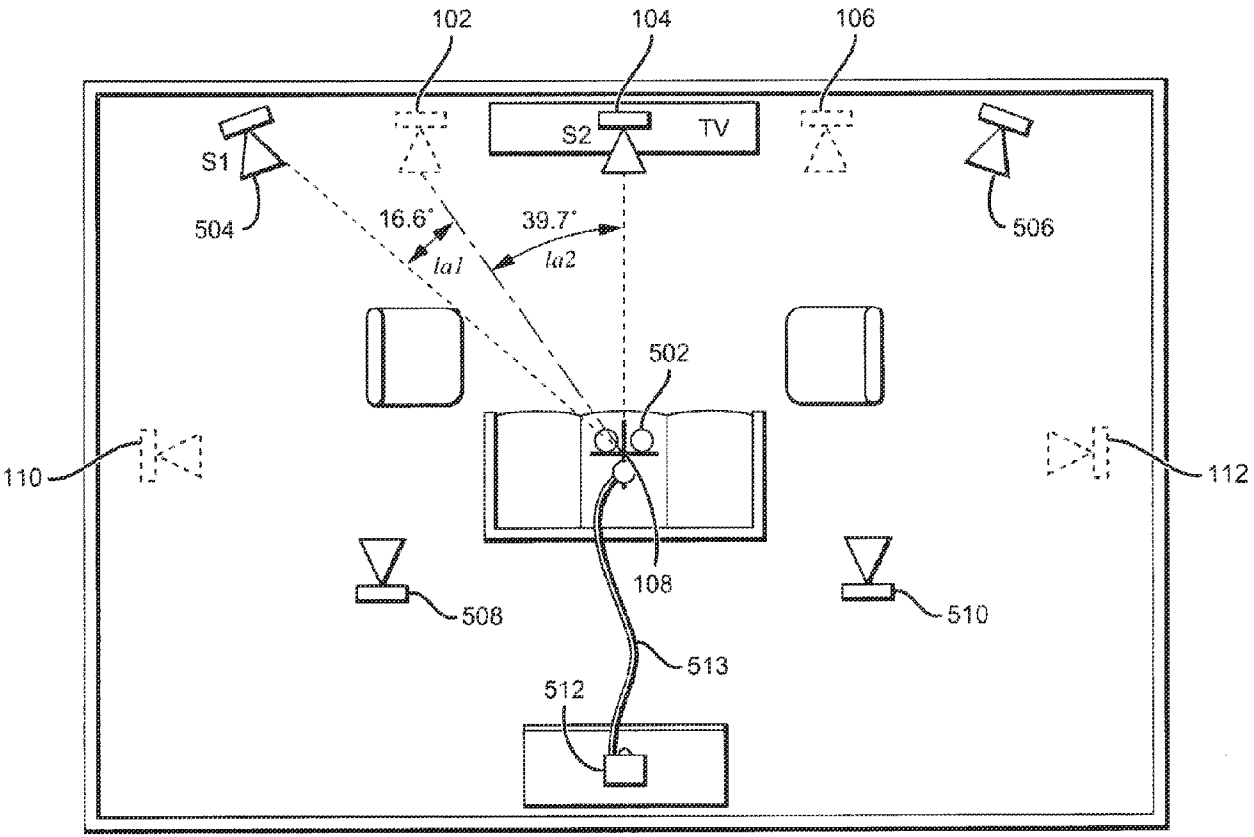
FIG. 5 is a block diagram of an audio system configured with, in one embodiment, a plurality of microphones to enable design of an audio output simulating ideal channel placement relative to a listening position.

FIG. 5 illustrates the use of a plurality of microphones 502 in the room first illustrated in FIG. 1 to enable design of audio parameters for rotation of a multi-channel sound field that simulates ideal channels using speakers arranged in positions that deviate from the predetermined ideal channel locations. Ideal left, center and right channels (102, 104, 106) and ideal surround left and right channels (110, 112) are illustrated as dashed lines to show their respective ideal placements in relation to the listener position 108. To facilitate discussion of one embodiment of the algorithm that follows, arbitrary speaker placement positions are illustrated with solid lines and discussed for use with a 5.1 channel surround sound audio encoding signal. For example, front left and front right speakers (504, 506) are illustrated in positions further removed from the ideal center channel 104 than would be pre-determined for 5.1 surround sound ideal channel placement. Similarly, surround left and surround right speakers (508, 510) are illustrated with solid lines and positioned removed from what is prescribed for playback of a 5.1 channel surround sound audio encoding signal. A sound source 512 is positioned in communication with the speakers (504, 104, 506, 508, 510) to analog audio and data signals through a physical connection such as the home's power wiring system. Or, preferably, audio signals and data signals are sent to such respective speakers using an RF wireless transmitter and receiver (not shown) in said sound source 512 to transmit such audio and control signals. Also illustrated is the plurality of microphones 502 that are each spaced apart from one another, positioned about a listening position, and in communication with the sound source 512 through a microphone cable 513 to enable initial design of audio parameters to rotate a multi-channel sound field to simulate ideal channel placement as will be described, below.

Figure 6:
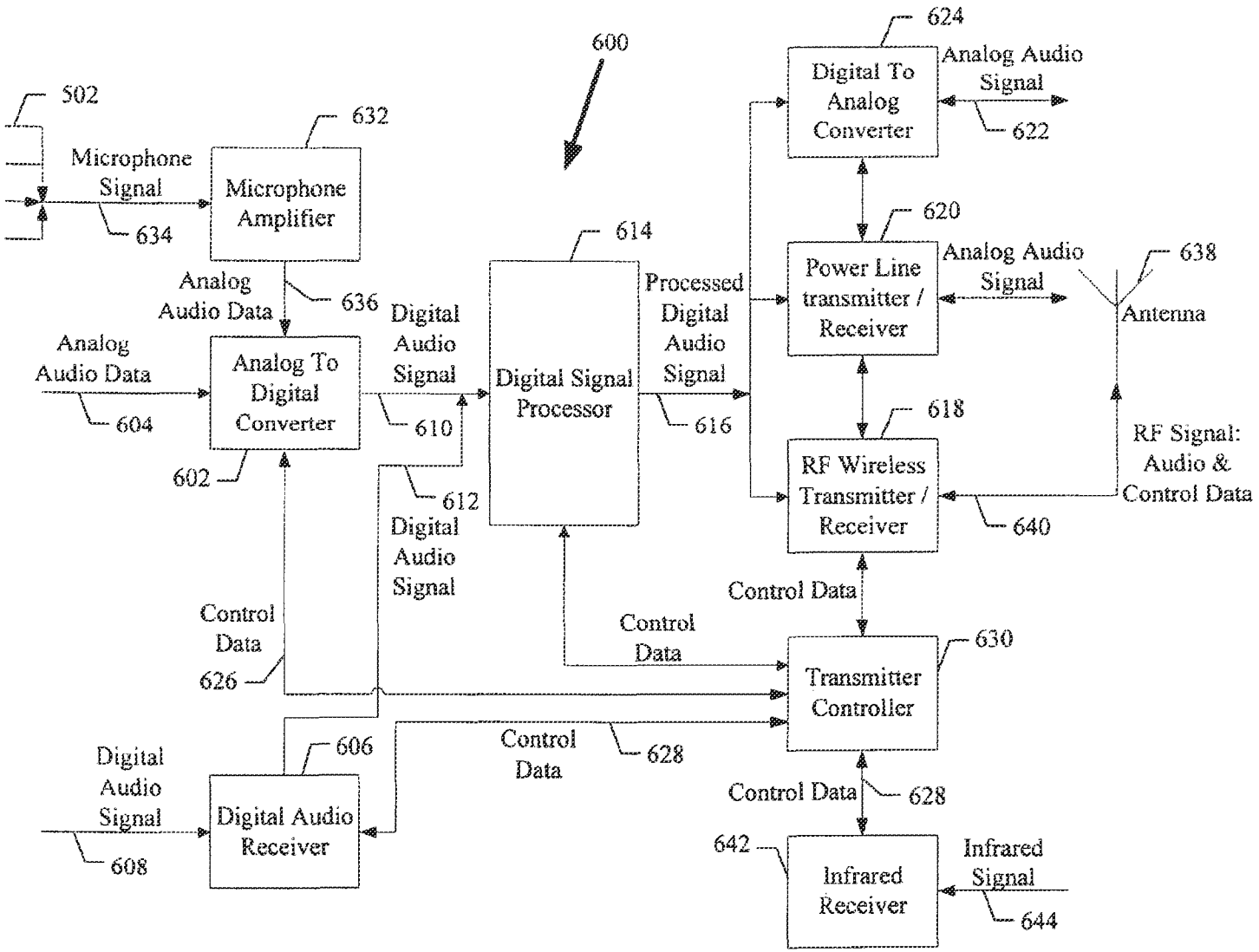
FIG. 6 is block diagram of, in one embodiment, a transmitter for designing and transmitting a multi-channel audio signal to steer a plurality of audio channels to simulate ideal channel placement relative to a listening position.

Referring to FIGS. 5 and 6, the audio source 512, in one embodiment a transmitter 600, has an analog to digital converter ("A/D converter") 602 to receive analog audio data 604 such as may be received from an RC connector, audio jack or mini-DIN connector for conversion of analog audio signals to digital audio signals. A digital audio receiver 606 is also preferably provided in the transmitter 600 to receive a digital audio signal 608 such as from a digital coaxial audio connector, Toslink connector, IEEE 1394 interface, or other suitable digital audio connection to receive standard, de facto standard or proprietary digital audio and control data signals. Digital audio signal paths (610, 612) are provided for the A/D converter 602 and digital audio receiver 606, respectively, to communicate digital audio signals to a digital signal processor 614. The digital signal processor 614 consequently transmits a processed digital audio signal to processed digital audio signal path 616 to be transmitted either over the air through a radio frequency (RF) transmitter/receiver 618 or over power lines using a power line transmitter/receiver 620. The processed digital audio signal may also be converted to an analog audio signal 622 using a digital to analog converter 624 for presentation to an analog out terminal (not shown). Control data paths (626, 628) connected to the A/D converter 602 and digital audio receiver 606, respectively, enable communication of control data to a transmitter controller 630.

During operation, the transmitter controller 630 preferably sends control data information to the digital signal processor 614 for appropriate processing of digital audio signals entering the digital signal processor 614 from the A/D converter 602 and digital audio receiver 606. For example, the digital audio receiver 606 may communicate information to transmitter controller 630 providing the signal encoding method, such as PCM or Dolby encoding methods, for appropriate sampling of the digital audio signal provided from the digital audio receiver 606 to the digital signal processor 614 through the control data path 612. The A/D converter 602 may provide sampling rate information through the control data path 626 for the transmitter controller 630 to provide appropriate control data to the digital signal processor 614 for receipt of the digital audio signal from the A/D converter 602.

A microphone amplifier 632 is in communication with the A/D converter 602 through analog audio data path 636 to convey a microphone signal 634 to the digital signal processor 614 for design of audio parameters to allow rotation of a multi-channel sound field, in one embodiment of the invention.

In the embodiment of the invention that includes an RF wireless transmitter/receiver 618, an antenna 638 is connected to the RF wireless transmitter/receiver 618 through RF signal path 640 to receive RF signals having audio and control data. An RF receiver or, preferably, an infrared (IR) receiver 642, is configured to receive an infrared signal 644 containing transmitter 600 control data, such as volume, audio source selection, surround-sound encoding selection, lighting control (for further distribution) or other receiver end-user information for communication to transmitter controller 600 through control data path 646.

In one embodiment of operation illustrated in FIG. 7, the transmitter 600 performs a calculation of design parameters to enable rotation of a multi-channel sound field to simulate ideal channel placement. In anticipation of a non-ideal multi-speaker arrangement illustrated in FIG. 5, the digital signal processor initializes a speaker count to numeral 1 (Block 700). If the speaker count is not equal to the number of speakers previously detected by the digital signal processor plus one (Block 702) then one or more audio signals are broadcast through a subject speaker (a "calibration audio signal"), preferably on audio signal frequency sweep (Block 704). The broadcast calibration audio signal is received through a plurality of microphones positioned at a listening position (Block 706) and provided to the digital signal processor. In a preferred embodiment, three microphones are placed in one plane at corners of an equilateral triangle approximately 6 cm apart for detection of the physical placement of the subject speaker by the digital signal processor in two dimensions. Or, four microphones equidistant from each other such as in a tetrahedron, approximately 6 cm apart may be used for detection of the subject speaker in three dimensions. An impulse response for the broadcast calibration audio signal is calculated, preferably by taking the inverse Fourier transform (FFT) of the ratio of the FFT of the frequency sweep signal and FFT of the received microphone signal. (Block 708) A cross-over ("Xover") filter is calculated that is a fourth order Butterworth filter whose cut-off frequency is determined from the frequency response of the previously calculated impulse response. (Block 710) Preferably, the point at which the amplitude of the frequency response drops to −1 OdB of the maximum amplitude over the entire frequency range is taken as the cut-off frequency. A 4th order low pass coefficient and a 4th order Butterworth high pass filters coefficient are then calculated. Using the plurality of microphones described above, the subject speaker angle and height is calculated (Block 712) in relation to the listener's position (location of the microphones). More particularly, using the impulse response of each microphone, between every pair of microphones, the time difference ($\Delta t$) between the peak amplitude of the impulse responses is first calculated. The time difference (At) is utilized to give the angle of incidence of the sound direction. For example, a time difference (At) of zero seconds indicates that the sound arrived at both subject microphones in the pair simultaneously, and so the source is placed in the hyper-plane that is equidistant from both microphones. Similarly, a time difference (At) which is equal to the time taken by sound to cover the distance between the two microphones indicates that the source of the sound is in the straight line that joins the two subject microphones. The angle of the incoming sound with respect to the line joining the two microphones is calculated as the inverse cosign of the ratio At to the time taken by sound to traverse the distance between the two subject microphones. Each such angle represents a possible hyper-plane in which the subject speaker broadcasting the calibration signal can lie with respect to the subject pair of microphones. The physical location of the subject speaker in relation to the listening location is localized using data from the plurality of such microphone pairs. The physical location that gives the minimum error to all the calculated hyper-planes is taken as the location of the broadcasting speaker. Using the Cartesian coordinate of the broadcast sound source, the subject speaker's angle in the horizontal plane with respect to front and the height is calculated.

In response to receipt of the calibration signal broadcast through the subject speaker, the loudness of the subject speaker is determined to calculate level compensation (block 714) by computing the average of the magnitude of all the frequency responses for the subject speaker. The inverse of this is utilized to match the volume of each subsequent speaker. A delay compensation is calculated (block 716) by first calculating the delay between broadcast of the calibration signal and receipt of such signal at to the microphone, preferably through examination of the point at which the impulse repulse is at its maximum. This delay is then subtracted from the pre-determined maximum delay allowed by the system and used as a delay compensation factor. An EQ filter is calculated (block 718) for the subject speaker for later compensation of any uneven frequency response of the previously determined impulse response. The impulse response is first passed through a set of all-pass filters to mimic the non-linear frequency scale of a human auditory system. The magnitude (m) of this modified impulse response is then calculated using FFT. A finite impulse response (FIR), iw, is computed which is the minimum phase filter whose magnitude response is inverse of m. The FIR iw is then passed through a set of all-pass filters which inverts the non-linear mapping to yield the final EQ filter.

The speaker count is incremented (block 720) and the speaker count again compared to the maximum speakers in the audio system. If the speaker count is not equal to Max +1 speakers, then the process preferably repeats, with one or more calibration audio signals broadcast through the next subject speaker (blocks 702, 704). Or, if the speaker count is equal to Max +1 speakers (block 702), then the next step of the design process continues with the digital signal processor calculating a rotation matrix (block 722) using speaker angle and height data generated in block 712 described above.

Figure 8:
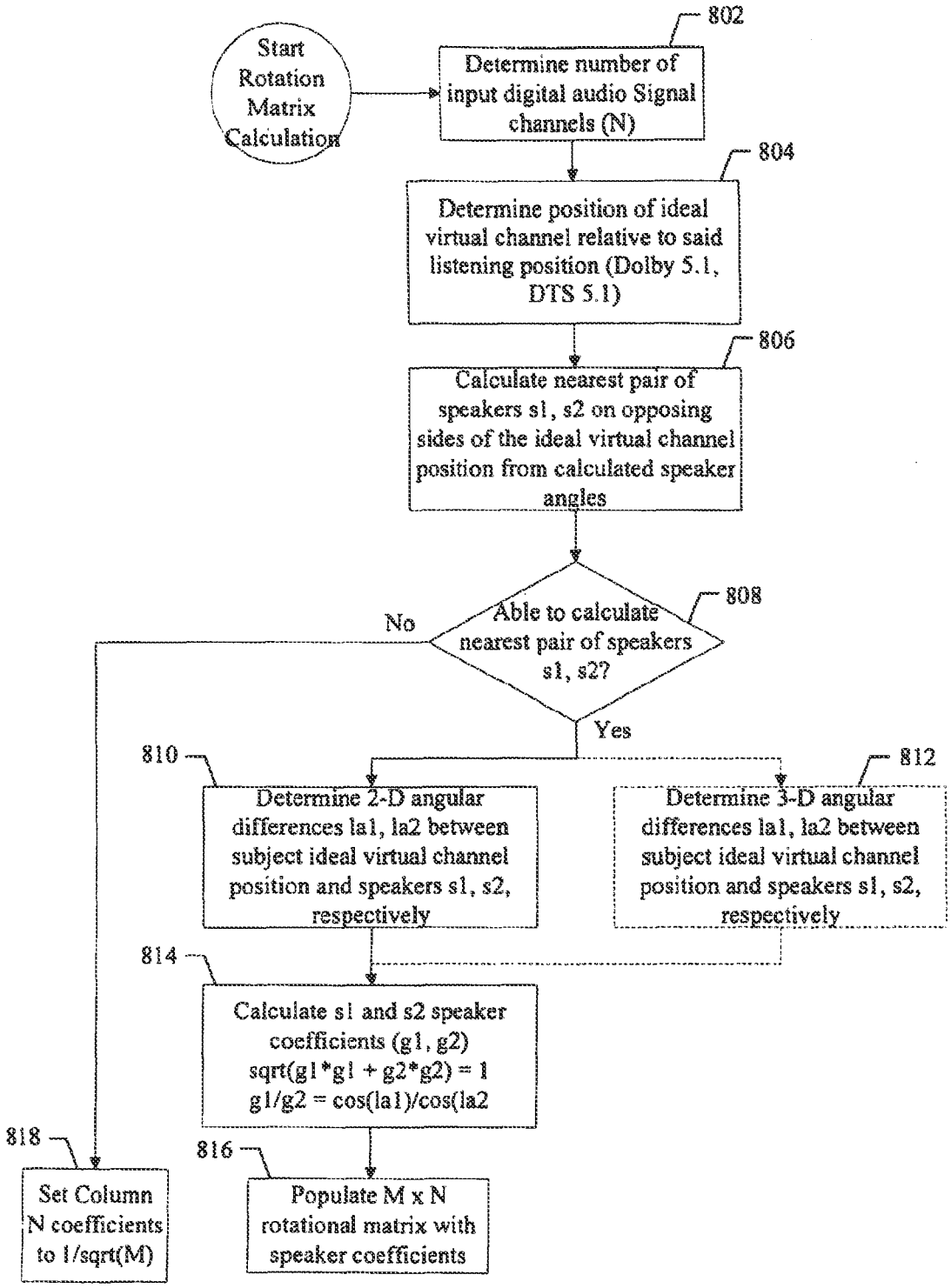
FIG. 8 is one embodiment of a flow diagram illustrating design of a rotation matrix for rotation of a multi-channel sound field.

Referring to FIG. 8, a flow diagram illustrates one embodiment of a design of a rotation matrix for rotation of a multi-channel sound field. The number of input digital audio signal channels is determined (block 802) for determination of associated positions of ideal virtual channels relative to the listening position (block 804). For example, a Dolby 5.1 or DTS 5.1 System would be defined by left and right front speakers located on opposing sides and 1.5 meters from a center channel. Left and right surround speakers would be located on opposing sides of a listening position and also spaced approximately 1.5 meters from such listening position. In response to capture of the broadcast calibration audio signal in all microphones, the nearest pair of speakers si and s2 on opposing sides of the subject ideal virtual channel position is calculated from the calculate speaker angles (block 806). If the system is successful at calculating the nearest pair of speakers (block 808), then the angular differences between speakers si and s2 and the subject ideal virtual channel position are determined (IaI, Ia2, respectively) (block 810) (See FIG. 5). For example, and as illustrated in FIG. 5, front left speaker 504 and center speaker 104 would represent speakers si and s2, respectively. Angles IaI and Ia2, representing the angular difference between speakers si and s2 and the subject ideal virtual channel position, respectively, are approximately 16.6 degrees and 39.7 degrees, respectively. In an alternative embodiment for an audio system that is capable of determining speaker locations in three dimensions, the 3-D angular differences (IaI, Ia2) between speakers si and s2 and their respective ideal virtual channel positions are determined (block 812). Speaker coefficients g1 and g2 are calculated for speakers si and s2, respectively, for the 2-D relationship, are described by (block 814):

$$\text{sqrt}(g1*g1+g2*g2)=1 \quad (1)$$

$$g1/g1=\cos(1aI)/\cos(1a2) \quad (2)$$

The M×N rotational matrix is then populated with the speaker coefficients (block 516).

If the audio system is unable to calculate the nearest pair of speakers si and s2 according to the above description (block 808), then column N for the subject ideal channel of the M×N rotational matrix is populated with coefficients set to 1/sqrt (M) to evenly distribute the digital audio input amplitude across the subject speakers (block 818).

Figure 9:
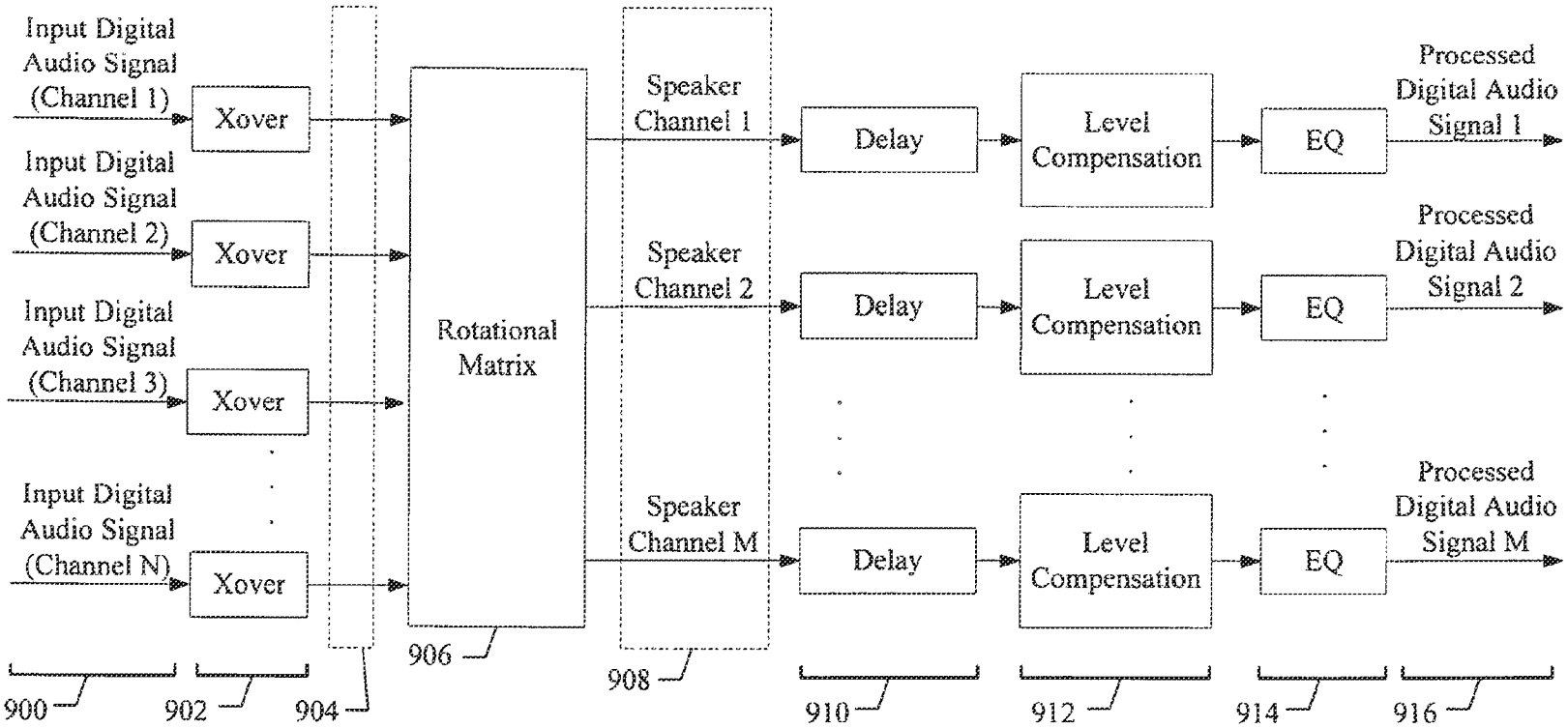
FIG. 9 is one embodiment of a flow diagram illustrating the use of the design parameters of FIGS. 7 and 8 to rotate a sound field for simulation of ideal channel placement in an audio system having non-ideal speaker placement.

In one embodiment using the rotation matrix illustrated in FIG. 8, FIG. 9 illustrates one embodiment of a flow diagram illustrating the use of such design parameters to rotate a sound field for simulation of ideal channel placement in an audio system having non-ideal speaker placement. The input digital audio signal channels (N) of the digital audio sample 900 are passed through respective cross-over filters 902 to form on input audio channel amplitude vector 904 that is multiplied with the rotational matrix 906 described in the flow diagram of FIG. 8 to generate a virtual output speaker channel amplitude vector 908. Speaker channels 1 through M are, in a 2-D embodiment of the rotational matrix 906, then preferably introduced through further audio compensation filters, such as respective delay compensation blocks 910, level compensation blocks 912 and EQ filters 914, for the resulting processed digital audio signals 1 through M 916 to be amplified and broadcast through respective speaker channels.

In an alternative embodiment that is configured for a 3-D rotational matrix (not shown), the delay compensation blocks may be omitted as a result of the three-dimensional and angular difference calculations that would be available for each speaker channel 1 through M without further delayed compensation.

Figure 10:
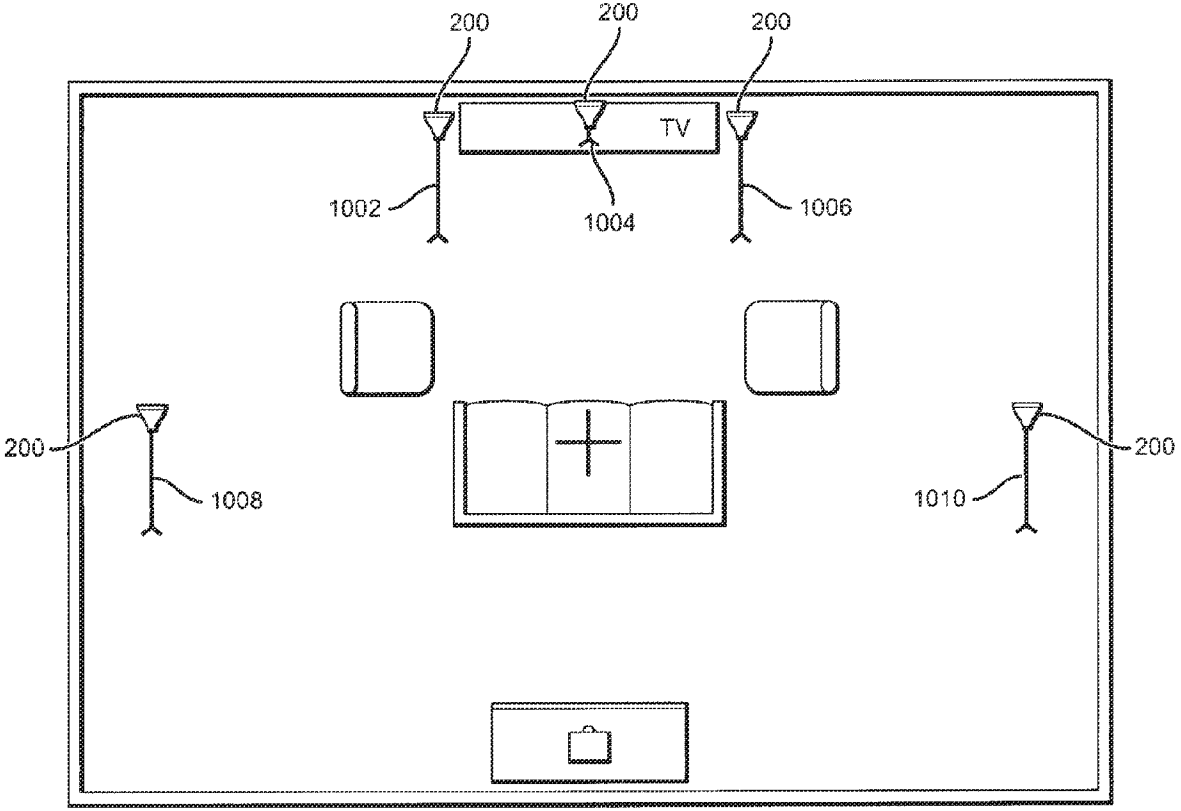
FIG. 10 is a block diagram of, in one embodiment, an audio system for use with the speaker and light assembly illustrated in FIGS. 2 and 3 to steer a plurality of digital input audio channels to simulate ideal channel placement relative to a listening position.

FIG. 10 illustrates one embodiment of a multi-channel audio system arrangement that uses the speaker and light assembly illustrated in FIGS. 2 and 3 to steer a sound field having a plurality of digital input audio channels to simulate ideal channel placement using speakers positioned in non-ideal locations. Front left, front right, center, left surround and right surround speaker and light assemblies (1002, 1004, 1006, 1008, 1010, respectively) are illustrated as free-standing torchiere light stands detachably connected to the speaker and light assembly illustrated in FIGS. 2 and 3. It is appreciated that such speaker and light assemblies may use a lamp base coupler suitable for the application and national standards legislation applicable to the geographic region of use, such as an Edison screw socket ("E" base) or bayonet mount ("B" base).

An alternative embodiment of an audio system is an audio system assembly in a room (not shown) that uses the speaker and light assembly illustrated in FIGS. 2 and 3. Speaker and light assemblies 200 can be detachably coupled to torchiere lamp posts (not shown) for the left front, center and right front speakers (1002, 1004, 1006). In this embodiment, the speaker and light assemblies 200 can also be attached to a left surround wall sconce (not shown) and right surround wall sconce (not shown), preferably for receipt of an RF signal. Alternatively, the speaker and light assemblies 200 may receive audio and control data from the room's power lines (not shown) electrically connected to the sound source 512.

While various implementations of the invention have been described, it will be apparent to those of ordinary skill in the art that many more embodiments and implementations are possible that are within the scope of this invention.

We claim:

1. A method of simulating an ideal virtual channel position in an audio system, said method comprising:

broadcasting at least one calibration audio signal through each of a plurality of speakers (M) in said audio system;

receiving the calibration audio signal in a plurality of microphones spaced apart and positioned at a predetermined listening position;

calculating a speaker placement angle relative to said predetermined listening position, wherein said angle is determined using an impulse response to said calibration audio signal, and wherein said angle is calculated between each of said plurality of speakers (M) and said plurality of microphones;

determining a multi-planar angular location for each of said plurality of speakers (M) in relation to said listening position to facilitate a simulation of an ideal virtual channel position;

rotating a sound field using at least a parameter obtained from a calculation of the angular location relative to said listening position; and amplifying at least a virtual output audio channel amplitude vector through said plurality of speakers (M) thereby rotating said sound field.

2. The method of claim 1, further comprising:

receiving at least a digital audio sample comprising a plurality of input digital audio signal channels (N) to generate at least an input audio channel amplitude vector representing said sound field;

determining said ideal virtual channel position relative to said listening position for each of said plurality of input digital audio signal channels (N);

rotating said sound field to generate the virtual output audio channel amplitude vector to simulate said ideal virtual channel position relative to said listening position; and amplifying said virtual output audio channel amplitude vector through said plurality of speakers (M).

3. The method of claim 2, wherein the rotating of said sound field comprises:

mapping said input digital audio signal channels (N) to said plurality of speakers (M); and multiplying said input audio channel amplitude vector by the mapping to generate said virtual output speaker channel amplitude vector.

4. The method of claim 3, wherein the mapping of said input digital audio signal channels (N) comprises:

calculating, for each of said ideal virtual channel position, at least a nearest pair of speakers (s1, s2) on opposing sides of said ideal virtual channel position and selected from said plurality of speakers (M);

calculating, relative to said listening position, relative angular differences (Ia1, Ia2) between each of the nearest pair of speakers (s1, s2) and their ideal virtual channel positions;

calculating rotational matrix coefficients g1 and g2 according to: sqrt(g1*g1+g2*g2)=1; g1/g2=cos(Ia1 )/cos(Ia2); and populating at least an M×N rotational matrix with said coefficients g1 and g2 at cells MiN1 and M2Ni, respectively.

5. The method of claim 2, wherein the broadcasting of at least one calibration audio signal is performed sequentially through each of said plurality of speakers (M).

6. The method of claim 2, wherein said calibration audio signal comprises a frequency sweep.

7. The method of claim 2, wherein said plurality of input digital audio signals (N) are rotated for amplification through said plurality of speakers (M) for broadcast in said audio system that simulates said ideal virtual channel positions relative to said listening position.

8. A method of simulating an ideal virtual channel position in an audio system, said method comprising:

broadcasting at least one calibration audio signal through each of a plurality of speakers (M) in said audio system;

receiving the calibration audio signal in a plurality of microphones spaced apart and positioned at a predetermined listening position;

calculating a speaker placement angle relative to said predetermined listening position, wherein said angle is determined using an impulse response to said calibration audio signal, and wherein said angle is calculated between each of said plurality of speakers (M) and said plurality of microphones;

determining a multi-planar angular location for each of said plurality of speakers (M) in relation to said listening position to facilitate a simulation of an ideal virtual channel position;

rotating a sound field using at least a parameter obtained from a calculation of the angular location relative to said listening position;

amplifying at least a virtual output audio channel amplitude vector through said plurality of speakers (M) thereby rotating said sound field;

receiving at least a digital audio sample comprising a plurality of input digital audio signal channels (N) to generate at least an input audio channel amplitude vector representing said sound field;

determining said ideal virtual channel position relative to said listening position for each of said plurality of input digital audio signal channels (N);

rotating said sound field to generate the virtual output audio channel amplitude vector to simulate said ideal virtual channel position relative to said listening position; and amplifying said virtual output audio channel amplitude vector through said plurality of speakers (M).

9. The method of claim 8, wherein the rotating of said sound field comprises:

mapping said input digital audio signal channels (N) to said plurality of speakers (M); and multiplying said input audio channel amplitude vector by the mapping to generate said virtual output speaker channel amplitude vector.

10. The method of claim 9, wherein the mapping of said input digital audio signal channels (N) comprises:

calculating, for each of said ideal virtual channel position, at least a nearest pair of speakers (s1, s2) on opposing sides of said ideal virtual channel position and selected from said plurality of speakers (M);

calculating, relative to said listening position, relative angular differences (Ia1, Ia2) between each of the nearest pair of speakers (s1, s2) and their ideal virtual channel positions;

calculating rotational matrix coefficients g1 and g2 according to: sqrt(g1*g1+g2*g2)=1;g1/g2=cos(Ia1)/cos(Ia2); and populating at least an M×N rotational matrix with said coefficients g1 and g2 at cells MiN1 and M2Ni, respectively.

11. The method of claim 8, wherein the broadcasting of at least one calibration audio signal is performed sequentially through each of said plurality of speakers (M).

12. The method of claim 8, wherein said calibration audio signal comprises a frequency sweep.

13. The method of claim 8, wherein said plurality of input digital audio signals (N) are rotated for amplification through said plurality of speakers (M) for broadcast in said audio system that simulates said ideal virtual channel positions relative to said listening position.

* * * * *